US006282908B1

(12) United States Patent
Weldon

(10) Patent No.: US 6,282,908 B1
(45) Date of Patent: Sep. 4, 2001

(54) HIGH EFFICIENCY MALONE COMPRESSOR

(76) Inventor: Mark Weldon, 4938 Look Kinney Cir., Liverpool, NY (US) 13088

( * ) Notice: Subject to any disclaimer, the term of this patent is extended or adjusted under 35 U.S.C. 154(b) by 0 days.

(21) Appl. No.: 09/318,270

(22) Filed: Feb. 25, 1999

(51) Int. Cl.[7] ..... F25B 9/00
(52) U.S. Cl. ..... 62/6; 62/467; 417/332
(58) Field of Search ..... 62/6, 467; 417/322

(56) References Cited

U.S. PATENT DOCUMENTS

| | | | | |
|---|---|---|---|---|
| 4,353,218 | | 10/1982 | Wheatley et al. | 62/6 |
| 4,501,122 | * | 2/1985 | Cutler | 62/467 |
| 4,515,534 | | 5/1985 | Lawless et al. | 417/322 |
| 4,795,318 | | 1/1989 | Cusack | 417/322 |
| 4,842,493 | | 6/1989 | Nilsson | 417/322 |
| 5,215,446 | | 6/1993 | Takahashi et al. | 417/322 |
| 5,327,745 | | 7/1994 | Gilmour | 62/467 |
| 5,525,041 | | 6/1996 | Deak | 417/63 |
| 5,711,157 | * | 1/1998 | Ohtani et al. | 62/467 |

FOREIGN PATENT DOCUMENTS

| | | |
|---|---|---|
| 525483 | 11/1976 | (SU) . |
| 1222904 | 4/1986 | (SU) . |
| 1239420 | 6/1986 | (SU) . |

* cited by examiner

*Primary Examiner*—Ronald Capossela
(74) *Attorney, Agent, or Firm*—Richard C. Litman

(57) ABSTRACT

A high efficiency compressor and heat exchange assembly adapted for utilization in air-conditioning/refrigeration systems. The assembly includes an electromechanical compressor instead of a traditional mechanical compressor, to effect compression and displacement of a working fluid in a thermodynamic cycle. The use of a electromechanical compressor permits employment of the Malone (liquid) thermodynamic cycle which has an intrinsically higher efficiency than the conventional Gifford-McMahon thermodynamic cycle. The assembly incorporates heat exchange disks which enclose a chamber for the working fluid. A densely perforated regenerator is centered in the chamber for absorbing and returning heat to the working fluid during the thermodynamic cycle. Ducts, in fluid communication with the heat exchange disks, define circuits for the flow of heat exchange fluid.

13 Claims, 4 Drawing Sheets

HIGH EFFICIENCY MALONE COMPRESSOR

BACKGROUND OF THE INVENTION

1. Field of the Invention

The present invention generally relates to refrigeration or air-conditioning systems which operate over a closed thermodynamic cycle and, more specifically, to refrigeration or air-conditioning systems which utilize the Malone thermodynamic cycle in conjunction with an electromechanical compressor.

2. Description of the Related Art

Most refrigeration and air-conditioning systems currently in operation utilize the Gifford-McMahon thermodynamic cycle wherein phase change (condensation and evaporation) of a recirculating working fluid is utilized as a heat transfer medium. However, temperature restrictions at which the phase change and heat transfer must take place have heretofore limited the choice of working fluids to those classified as either chlorofluorocarbons (CFCs and HCFCs) or hydrofluorocarbons (HFCs). In recent years, severe damage to the environment has been attributed to the release of CFCs and HCFCs into the atmosphere. HFCs, though apparently environmentally safe, have proven to be a relatively expensive alternative. The refrigeration and air- conditioning systems in current use also require mechanical compressors, expanders, and heat exchangers of relatively large volume to handle the phase changes of the working fluid. Thus, allocation of compressor, expander, and heat exchanger space has been a limiting factor in any system design.

The idea to use a medium which is continuously liquid as a working fluid was extensively investigated by John Malone who theorized that an ideal thermodynamic cycle employing an all liquid working fluid (Malone cycle) would have an extremely high efficiency. However, the Malone cycle has not heretofore proven to be commercially viable since in actual practice, its performance has been found to be similar to that obtained using conventional phase change technology. Further investigation of Malone cycle performance demonstrated that nearly half of the total lost inefficiency could be attributed to compressor and expander inefficiency.

The utilization of a working fluid that is continuously in a liquid state (Malone cycle) is known in the art and is exemplified in U.S. Pat. No. 4,353,218 (Wheatley et al.) and U.S. Pat. No. 5,327,745 (Gilmour). It is noted, however, that these patents disclose the employment of mechanical means for providing compression force to the liquid.

U.S. Pat. No. 4,795,318 (Cusack), U.S. Pat. No. 4,842,493 (Nilsson), U.S. Pat. No. 5,215,446 (Takahashi et al.), U.S. Pat. No. 5,525,041 (Deak) and Soviet Union Patents numbers (525,438), (1,222,904), (1,239,420) all disclose electromechanical pumping devices for liquids. Compression of liquid for heat exchange purposes is not contemplated in the instant patents.

U.S. Pat. No. 4,515,534 discloses a electromechanical device for compressing a gas.

None of the above inventions and patents, taken either singularly or in combination, is seen to disclose a refrigeration or air-conditioning system utilizing the Malone cycle thermodynamic system in conjunction with an electromechanical compressor as described and claimed in the instant invention.

SUMMARY OF THE INVENTION

The present invention was conceived as part of an examination of the limitations of current refrigeration/air-conditioning compressor technology. The thrust of the inventive concept is to change the compression task from performing large amounts of work at relatively low frequency to that of performing smaller amounts of work at very high frequency. Reduction of the above concept to practice precluded the use of standard mechanical compressor hardware (pistons, crankshafts, gear pumps, etc.) and suggested the use of piezoceramic or magnetostrictive actuators to perform compression in a thermodynamic environment which would incorporate the Malone cycle in lieu of the Gifford-McMahon cycle.

Piezoceramic or magnetostrictive actuators will elongate and contract with rapid, precisely-controlled strokes of more than 0.1% of their length and with great force when electrically pulsed. These actuator length changes act in a working fluid chamber to cause the working fluid to be alternately compressed, displaced, expanded, and displaced back again according to flow characteristics required in the Malone cycle. Furthermore, piezoceramic actuators are electrically capacitive and can hold an electric charge virtually indefinitely. This characteristic allows piezoceramic actuators to be distended and held against great pressure without continuous current draw, thus reducing the amount of electrical energy input per cycle. The use of piezoceramic or magnetostrictive actuators offers enormous opportunity to achieve high energy efficiency via electronic control of the stroke, wave form, frequency, and coupling resonance of the actuators. An important optimizing feature of the control circuitry, of the present invention, is its ability to seek the resonant frequency of the actuators. It was therefore determined that a piezoceramic or magnetostrictive compressor would enhance the operation of the Malone thermodynamic cycle in performing the refrigeration/air-conditioning function.

The present invention comprises a thermodynamic device that utilizes a non-toxic, environmentally friendly working fluid which is consistently in a liquid phase. A piezoceramic actuator is employed to cause the working fluid to be alternately compressed, displaced, expanded, and displaced back again in accordance with Malone thermodynamic cycle flow. A tubular shell houses the actuator and the working fluid in a sealed chamber. The tubular shell incorporates a novel regenerator assembly which is centered in the working fluid and is coupled to heat-exchange surfaces, which surfaces are mounted to the tubular shell.

Accordingly, it is a principal object of the invention to provide a refrigeration/air-conditioning device operating with a consistently liquid working fluid.

It is another object of the invention to provide a refrigeration/air-conditioning device operating in the Malone cycle thermodynamic mode.

It is a further object of the invention to provide a refrigeration/air-conditioning device which employs a piezoceramic actuator.

Still another object of the invention is to provide a refrigeration/air-conditioning device which utilizes a working fluid that is friendly to the environment.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
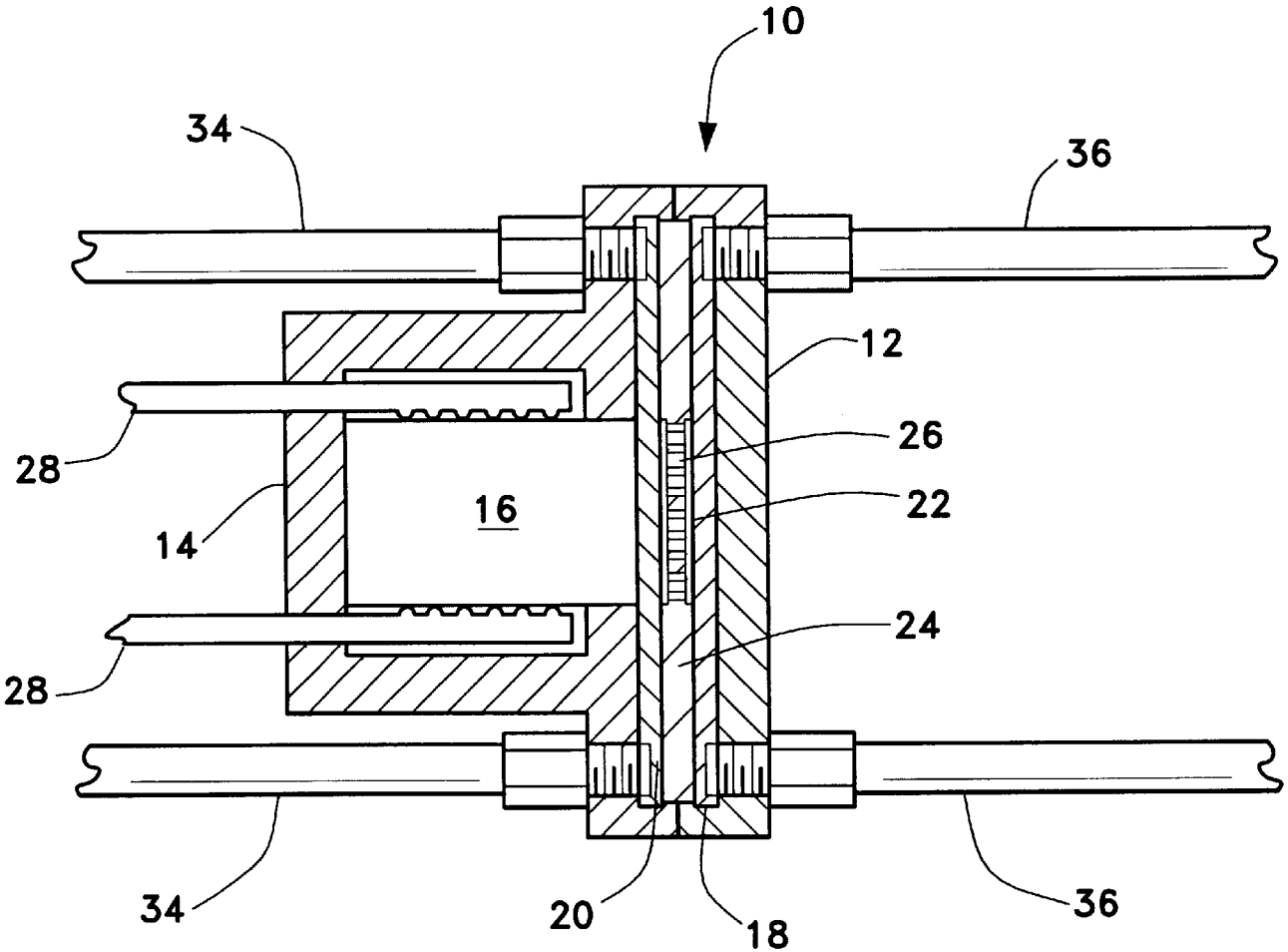
FIG. 1 is a sectional plan view of a first embodiment of the present invention.

Referring now to the drawings, and more particularly to FIG. 1, there is shown a compressor having a tubular shell 10 which is formed by the conjunction of the flanged edges of end caps 12 and 14, one or more of which may be removable. The shell is precision-fabricated from material characterized by high strength, low thermal conductivity, and a nearly zero coefficient of thermal expansion.

A piezoceramic actuator 16 is disposed within a cavity formed in end cap 14. The shell so formed by end caps 12 and 14 encapsulates spaced disk-shaped heat exchangers 18 and 20. Piezoceramic actuator 16 abuts a surface of heat exchanger 20. The respective surfaces of the heat exchangers 18, 20 which abut end caps 12 and 14 are coated with a thermal barrier such as MYLAR. An oscillating regenerator 24 is disposed in the space between disk-shaped heat exchangers 18 and 20 and defines a sealed chamber 22 in a central area of shell 10. Chamber 22 is filled with a non-toxic, environmentally friendly liquid working fluid. A densely perforated core portion 26 of oscillating regenerator 24 is centered in the working fluid and partitions chamber 22 to form two working chambers. Electrodes 28 are coupled to actuator 16 for providing pulsed electrical energy thereto.

Figure 5:
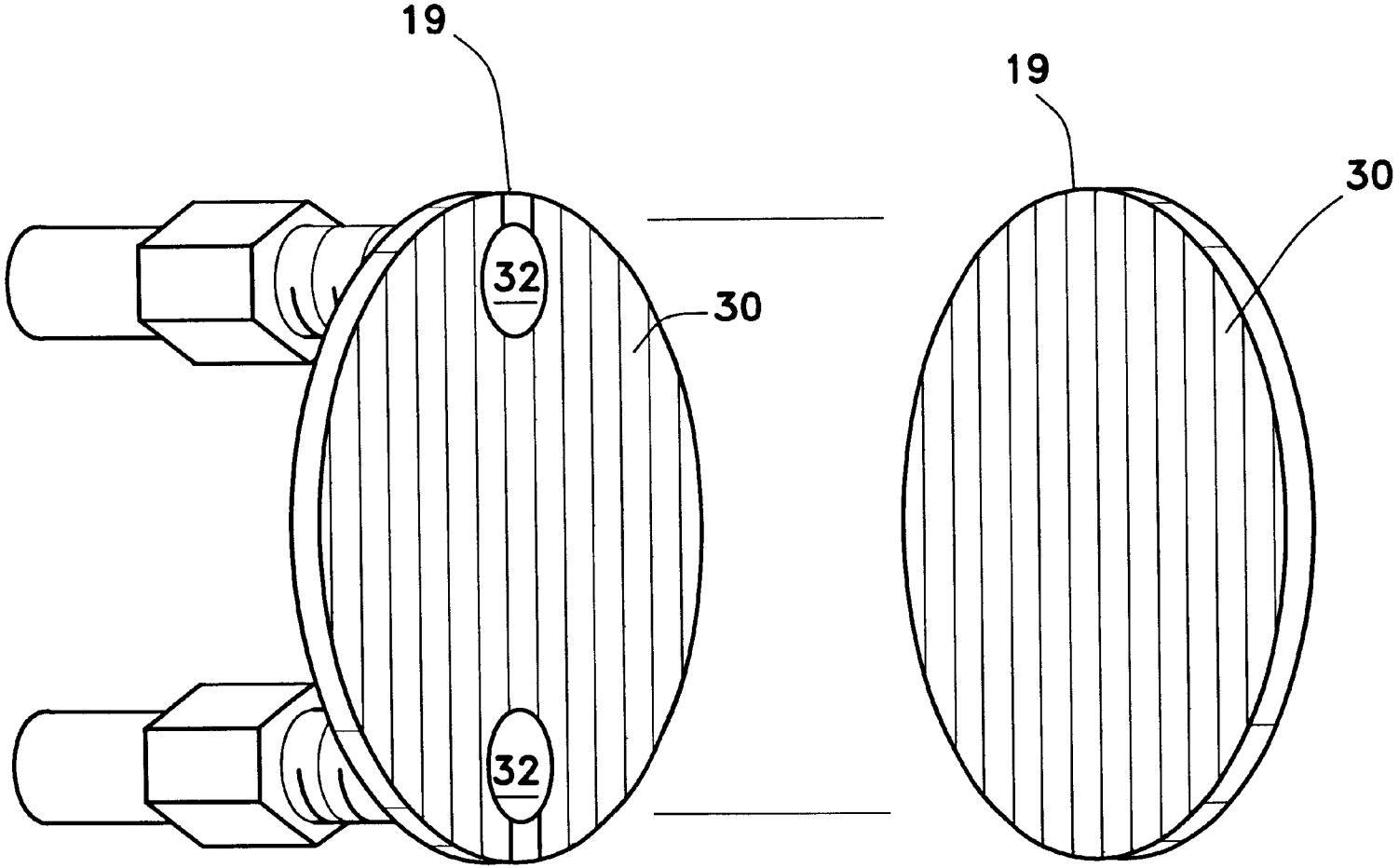
FIG. 5 is an exploded view of an internal heat exchanger according to the present invention.

The structure of heat exchanger 20 is best illustrated in FIG. 5. Heat exchanger 20 is fabricated of two layers 19 of thermally conductive material (e.g. beryllium copper). The two layers are fused together to form heat exchanger 20. High density micro-channels 30 are chemically milled into at least one surface (preferably both) of the facing surfaces of the fused layers. The micro-channels are adapted to conduct heat exchange liquid to and from opposite ports 32 formed in the periphery of the heat exchangers. The structure of heat exchanger 18 is identical to that of heat exchanger 20.

Figure 2:
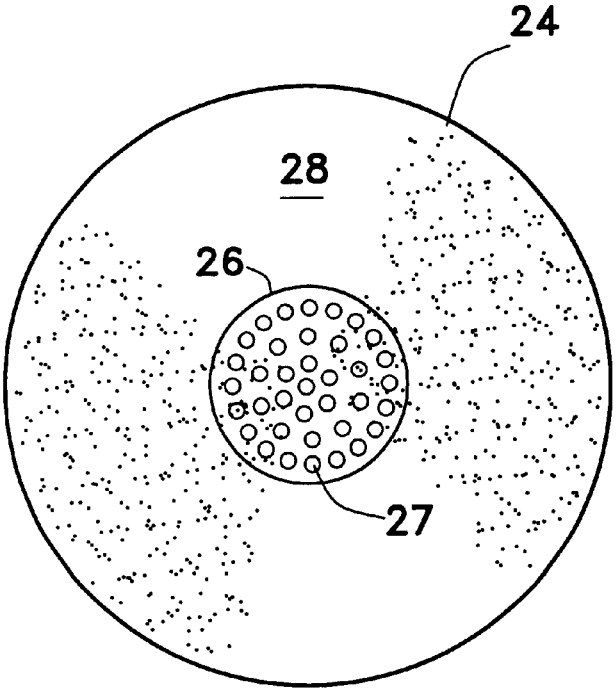
FIG. 2 is a front view of a regenerator utilized in the present invention.
Figure 3:
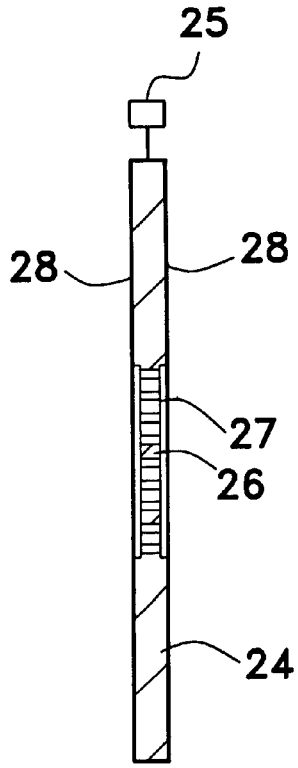
FIG. 3 is a side view of the regenerator depicted in FIG. 2 with the addition of an electronic driver.
Figure 4:
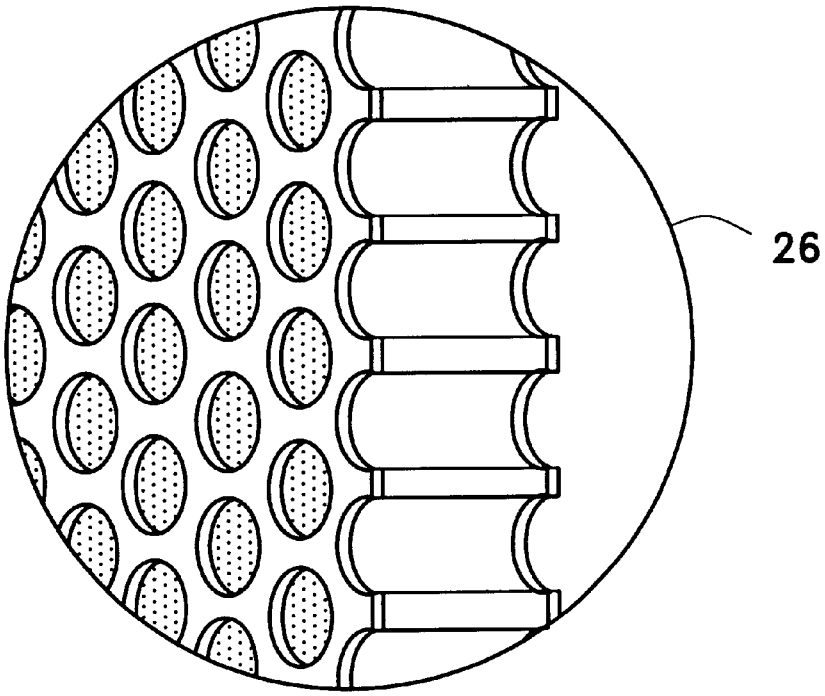
FIG. 4 is a perspective view of the regenerator core depicted in FIG. 2.

Oscillating regenerator 24, as best seen in FIGS. 2–4, performs the classic function of absorbing as much heat as possible from the working fluid during a first mode and returning heat to the working fluid during a second mode. The oscillating regenerator is made from a material with high specific heat capacity and thermal conductivity. Regenerator core 26 is densely perforated across its entire surface with tiny perforations 27 which allow the working fluid to pass therethrough during the displacement steps of the Malone cycle. Core 26 is coated on both sides with a thin thermal insulation 28 such as MYLAR. Insulation 28 functions as a thermal barrier limiting heat flow between the working chambers. Regenerator 24 is designed to absorb or desorb as much heat as possible from or to the working fluid passing therethrough without creating too great a pressure drop. A means such as a piezo or magnetostrictive ring, indicated at 25, is coupled to the regenerator 24 to cause the regenerator to oscillate through the working fluid as will be explained below.

Again with reference to FIG. 1, the present invention contemplates two external heat exchange circuits. Conduits 34 and 36 are in flow communication with respective ports 32 formed in heat exchangers 18 and 20. Conduits 34 and heat exchanger 20 comprise a "cold" side or heat absorption circuit. The direction of flow is from top to bottom i.e. inwardly from the top conduit 34 downward through micro-channels 30 in heat exchanger 20 and outward via bottom conduit 34. Conduits 36 and heat exchanger 18 comprise a "hot" side or heat rejection circuit. The direction of flow in the "hot" circuit is from bottom to top. Both circuits utilize a steady-state, non-toxic liquid.

In operation, electric energy is supplied to electrodes 28 causing piezoceramic actuator 16 to rapidly cycle (elongate/retract) and thereby causing the working fluid in chamber 22 to compress and expand. Simultaneously, electric energy is supplied to regenerator 24 via a piezo or magnetostrictive ring 25 causing regenerator core 26 to oscillate from contact with one side of chamber 22 to contact with the other side. In effect, the regenerator 24 is displaced through the working fluid rather than the working fluid being displaced through a stationary regenerator. By electronically controlling the timing of piezoceramic actuator cycling and regenerator oscillation, the working fluid in chamber 22 will be compressed, displaced, expanded, and displaced back again in accordance with thermodynamic Malone cycle flow. Thus, the working fluid will give up heat to one heat exchanger and absorb heat from the other heat exchanger. In turn, the fluid flowing through the two circuits as defined by conduits 34 and 36 will respectively either absorb heat from or give up heat to heat exchangers 18 and 20.

Figure 6:
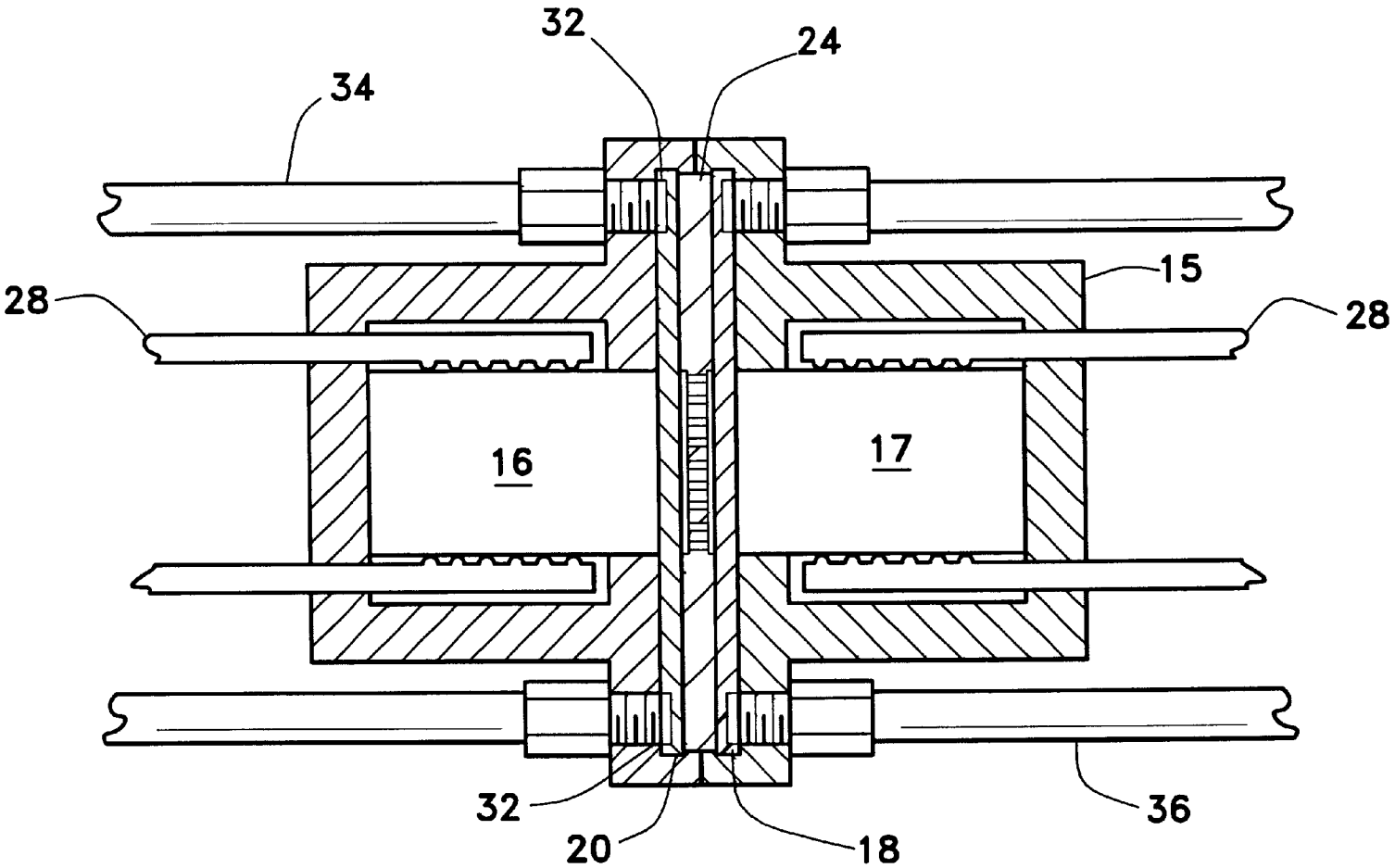
FIG. 6 is a plan view of a second embodiment according to the present invention.

The embodiment of FIG. 6 incorporates a second piezoceramic actuator 17 and cap 15 identical to actuator 16 and cap 14 as described above. Actuator 17 and cap 15 replace the cap 12 of the first embodiment. Arrangement and construction of conduits 34, 36 and heat exchangers 18, 20, of the second embodiment, are the same as described in the first embodiment. Although of similar construction to the regenerator illustrated in FIGS. 3–5, regenerator 24 of FIG. 6 lacks means to cause oscillatory movement. Thus, two symmetrical and opposing piezoceramic actuators 16 and 17 are timed to accomplish compression, expansion, and displacement of the working fluid with a stationary regenerator centered in the working fluid.

The quantity of electrical energy required to drive the compression and displacement steps of the cycle can be minimized by careful attention to the inherent, unique properties of the actuator. For example, potential energy stored in the working fluid during compression is released as the working fluid "springs back" during expansion. The aforementioned "spring back" creates a head pressure which forces the piezoceramic actuator back to its resting length and produces a capacitive voltage in the actuator, a portion of which can be used during subsequent actuator elongations.

It is to be understood that the present invention is not limited to the embodiments described above, but encompasses any and embodiments within the scope of the following claims.

I claim:

1. A high efficiency heat exchange device comprising:

opposed end caps, said end caps having flanged ends conjoined to form a tubular shell;

first heat exchange means and second heat exchange means interposed between said end caps;

a chamber formed between said first and second heat exchange means;

a non-toxic, environmentally-safe liquid working fluid contained within said chamber;

a regenerator having a core portion centrally positioned in said chamber and having peripheral walls forming a seal for said chamber, whereby said working fluid is confined within said chamber;

means for oscillating the core portion of said regenerator; and means for causing said working fluid to be compressed and displaced within said chamber.

2. The device as defined in claim 1 wherein each of said first and second heat exchange means comprises a a disk-shaped member having an upper port and a lower port;

passages formed within each said disk-shaped member, said passages extending between each said upper port and said lower port; and upper and lower conduits in respective fluid communication with each said upper port and said lower port, each said upper and lower conduits respectively forming a first and a second circuit with each said disk-shaped member, whereby a heat exchange fluid flows from a respective one of each said upper and lower conduits through said passages and into the other of each said upper and lower conduits.

3. The device as defined in claim 2 wherein each said disk-shaped member is fabricated of fused layers of thermally conducting material.

4. The device as defined in claim 1 wherein said core portion of said regenerator comprises a disk having two faces and having plural perforations therethrough.

5. The device as defined in claim 4 wherein said two faces of said core portion are coated with a material which forms a thin thermal barrier.

6. The device as defined in claim 5 wherein said material which forms a thin thermal barrier is MYLAR.

7. The device as defined in claim 6 wherein said means for oscillating said core portion is coupled to said regenerator.

8. The device as defined in claim 1 wherein said means for causing said working fluid to be compressed and displaced comprises an electromechanical compressor.

9. The device as defined in claim 8 wherein said electromechanical compressor is a piezoceramic actuator.

10. The device as defined in claim 9 wherein said piezoceramic actuator is positioned in an interior cavity of said tubular shell in abutment with said heat exchange means.

11. A high efficiency heat exchange device comprising:

opposed end caps arranged to form a tubular shell, each said end cap having a cavity respectively formed therein;

first heat exchange means and second heat exchange means interposed respectively between said end caps;

a chamber formed between said first and second heat exchange means;

a liquid working fluid contained within said chamber;

a regenerator having a core portion centrally positioned in said chamber and having peripheral walls forming a seal for said chamber whereby said working fluid is confined within said chamber; and means for causing said working fluid to be compressed and displaced within said chamber.

12. The device as defined in claim 11 wherein said means for causing said working fluid to be compressed and displaced comprises an electromechanical compressor positioned in each said cavity.

13. The device as defined in claim 12 wherein said electro-mechanical compressors are piezoceramic actuators.

* * * * *